US010351304B2

(12) United States Patent
Hartley

(10) Patent No.: US 10,351,304 B2
(45) Date of Patent: Jul. 16, 2019

(54) PACKAGE OPENING SUPPORT

(71) Applicant: Sonoco Development, Inc., Hartsville, SC (US)

(72) Inventor: Scott Huntington Hartley, Columbia, SC (US)

(73) Assignee: SONOCO DEVELOPMENT, INC., Hartsville, SC (US)

( * ) Notice: Subject to any disclaimer, the term of this patent is extended or adjusted under 35 U.S.C. 154(b) by 302 days.

(21) Appl. No.: 15/479,939

(22) Filed: Apr. 5, 2017

(65) Prior Publication Data

US 2017/0203881 A1 Jul. 20, 2017

Related U.S. Application Data

(63) Continuation of application No. 14/722,428, filed on May 27, 2015, now Pat. No. 9,682,809.

(51) Int. Cl.

| | |
|---|---|
| ***B65D 77/22*** | (2006.01) |
| ***B65D 77/12*** | (2006.01) |
| ***B65D 75/00*** | (2006.01) |
| ***B65D 33/00*** | (2006.01) |
| ***B65D 75/58*** | (2006.01) |
| ***B65D 33/25*** | (2006.01) |

(52) U.S. Cl.

CPC ..... *B65D 33/007* (2013.01); *B65D 33/25* (2013.01); *B65D 75/008* (2013.01); *B65D 75/58* (2013.01); *B65D 77/12* (2013.01); *B65D 77/22* (2013.01)

(58) Field of Classification Search

CPC ..... B31B 70/008; B31B 70/61; B31B 70/81; B31B 70/812; B31B 70/8122; B31B 70/8123; B31B 70/813; B31B 70/85; B31B 2120/40; B31B 2120/402

USPC ..... 493/213, 214, 215, 217, 218, 219

See application file for complete search history.

(56) References Cited

U.S. PATENT DOCUMENTS

| | | | |
|---|---|---|---|
| 2,150,627 | A | 3/1939 | Issac |
| 2,650,016 | A | 8/1953 | McMillan |
| 3,189,253 | A | 6/1965 | Mojonnier |

(Continued)

FOREIGN PATENT DOCUMENTS

| | | |
|---|---|---|
| CA | 2 183 831 | 3/1997 |
| EP | 1 084 956 A1 | 3/2001 |

*Primary Examiner* — Hemant Desai
*Assistant Examiner* — Christopher Robin Kim
(74) *Attorney, Agent, or Firm* — Nelson Mullins Riley & Scarborough, LLP

(57) ABSTRACT

A package, such as a bag or stand-up pouch, is described that includes a built-in opening support that can be actuated by the user to maintain the package in an open or wide-open configuration, thereby preventing or reducing the need to manually keep the front and back panels of the package separated as product is accessed. The opening support may be disposed near the opening end of at least one of the front or back panels and may be designed to be moved from an inactive position to an active position. In the inactive position, the opening support is disposed along one of the front panel or the back panel, whereas in the active position, the opening support extends between the front panel and the back panel, across a corresponding longitudinal seam of the package, to maintain the opening of the package in a wide-open position.

9 Claims, 5 Drawing Sheets

(56) References Cited

U.S. PATENT DOCUMENTS 3,589,595 A * 6/1971 White ..... B65D 33/14 206/806
4,069,994 A 1/1978 Wharmby
4,379,519 A 4/1983 Sherwood
4,417,609 A 11/1983 Sherwood
4,946,292 A 8/1990 Diamond et al.
4,978,232 A 12/1990 Dunton
5,037,138 A 8/1991 McClintock et al.
5,044,774 A 9/1991 Bullard et al.
5,132,124 A 7/1992 Tamaki et al.
5,160,196 A 11/1992 Curtis
5,174,658 A 12/1992 Cook et al.
5,184,896 A * 2/1993 Hammond ..... B65D 33/007 383/104
5,609,419 A 3/1997 Byers, Jr.
6,022,144 A * 2/2000 Hausslein ..... B65D 33/30 383/33
6,234,674 B1 5/2001 Byers, Jr.
6,371,642 B1 4/2002 Nelson et al.
6,494,619 B1 12/2002 Sulpizio
6,641,187 B2 11/2003 Hsu
6,743,492 B2 * 6/2004 Bray ..... B32B 27/06 428/35.2
7,104,293 B2 9/2006 Lais et al.
7,416,337 B2 8/2008 Munch-Fall
8,678,650 B2 3/2014 Savage
9,682,809 B2 * 6/2017 Hartley ..... B65D 77/22
2005/0276523 A1 12/2005 Munch-Fall
2006/0193541 A1 8/2006 Norcom
2010/0111447 A1 * 5/2010 Vergo ..... B65D 33/007 383/1
2011/0188785 A1 8/2011 Turvey et al.
2012/0057811 A1 * 3/2012 Tucker ..... B65F 1/0006 383/72
2013/0248541 A1 9/2013 Verma
2014/0014789 A1 1/2014 Verma
2016/0015388 A1 * 1/2016 Ren ..... A61B 17/06161 383/33

* cited by examiner

PACKAGE OPENING SUPPORT

CROSS-REFERENCE TO RELATED APPLICATIONS

This application is a continuation of U.S. patent application Ser. No. 14/722,428, filed May 27, 2015, which is incorporated by reference herein in its entirety.

BACKGROUND

The present disclosure relates in general to packaging for products, and more particularly to bags and pouches, such as stand-up pouches. The disclosure is especially concerned with structures and techniques for maintaining a bag or pouch in a wide-open configuration to facilitate a user's access to the contents held therein.

Flexible materials, such as polymers and flexible films, are often used to construct packages for products, such as bags and pouches. Such packages can be used to hold a variety of items, such as snack food including trail mix, chips, nuts, fruit pieces, and other foods. In some cases, as in the snack food example, the type of product contained in the package is meant for consumption by the user one piece or portion at a time. For example, the consumer may reach into the package to withdraw a portion of the snack food, put them in his or her mouth, and then reach into the package again to obtain another portion for consumption. This pattern repeats until the consumer is full and/or does not want to eat any more of the package contents.

In another example, such as when the package is a large "family" or "party size" package, it is common for a consumer to open the package containing the snack food and share the food with others. In this case, one person may reach into the package, withdraw one or more items for consumption, then pass the package on to the next person who may then do the same.

BRIEF SUMMARY

Embodiments of the invention described herein provide improved packages and methods for constructing packages that provide a mechanism for maintaining the package in an open configuration, such that the mouth or opening of the package does not need to be manually held in an open position. In cases in which the package is a bag or pouch made of flexible material, for example, the front and back panels of the package may need to be separated by the consumer to initially open the package and then held in the separated, open position while the consumer reaches inside the package to withdraw an item for consumption.

Accordingly, embodiments of the invention include an opening support disposed near the opening of the package that is designed to span a longitudinal seam of the package and maintain the package opening in a wide open configuration.

Accordingly, in some embodiments, a package is provided that includes a front panel defining an opening end, a base end, and two side edges, as well as a back panel defining an opening end, a base end, and two side edges. The back panel is connected to the front panel via longitudinal seams formed along respective side edges of the front and back panels. An opening support is disposed proximate the opening end of at least one of the front or back panels, and the opening support is configured to be moved from an inactive position to an active position. The opening end of the front panel and the opening end of the back panel define an opening of the package that is configured to provide access to contents of the package when the package is opened by a user. In the inactive position, the opening support is disposed along one of the front panel or the back panel, whereas in the active position, the opening support extends between the front panel and the back panel, across a corresponding longitudinal seam, to maintain the opening of the package in a wide-open position. In some cases, the package may further comprise a base panel connecting the base end of the front panel to the base end of the back panel, such that the package is a stand-up pouch.

The opening support may comprise a flexible strip of material defining a first end and a second end. In the inactive position, both the first end and the second end of the flexible strip of material may be removably attached to one of the front panel or the back panel. In the active position, the first end of the flexible strip of material may be removably attached to one of the front or back panels and the second end of the flexible strip of material may be removably attached to the other of the front or back panels, such that the flexible strip of material spans the corresponding longitudinal seam. Each of the first and second ends may include a region of pressure sensitive adhesive configured to removably attach the flexible strip of material to a respective one of the front or back panels.

In some embodiments, the opening support may comprise a flexible strip of material defining a first end and a second end, where, in the inactive position, the first end is fixedly attached to one of the front panel or the back panel and the second end is removably attached to the same one of the front panel or the back panel. In the active position, the second end may be configured to attach to the other of the front panel or the back panel, such that the flexible strip of material spans the corresponding longitudinal seam.

The second end may include a region of pressure sensitive adhesive configured to removably attach the flexible strip of material to a respective one of the front or back panels in the active position. Additionally or alternatively, an outer surface of a respective one of the front or back panels to which the second end is configured to removably attach may comprise a receiving feature configured to engage the second end. In some cases, the receiving feature may comprise a removable flap comprising a region of pressure sensitive adhesive configured to removably attach to the second end of the flexible strip of material in the active position. In other cases, the receiving feature may comprise a protrusion, and the second end of the flexible strip of material may comprise an indentation configured to engage the protrusion of the receiving feature in the active position.

In some embodiments, the opening support may be disposed on an outer surface of the package. In other embodiments, the opening support may be disposed on an inner surface of the package. The opening support may, in some cases, comprise a rigid member defining a fixed end and a free end, where the rigid member is configured to be moved between the inactive position, in which the rigid member is disposed along one of the front or back panels, and the active position, in which the rigid member extends across the longitudinal seam. The free end may be configured to engage a receiving member disposed on the other of the front or back panels when the opening support is in the active position. Moreover, the receiving member may comprise a groove configured to receive the free end of the rigid member to lock the rigid member in the active position.

In other embodiments, a method of manufacturing a package including an opening support is provided. The method includes forming a front panel defining an opening end, a base end, and two side edges and attaching a back panel defining an opening end, a base end, and two side edges to the front panel via longitudinal seams formed along respective side edges of the front and back panels. An opening support is disposed proximate the opening end of at least one of the front or back panels, and the opening support is configured to be moved from an inactive position to an active position. The opening end of the front panel and the opening end of the back panel define an opening of the package that is configured to provide access to contents of the package when the package is opened by a user. In the inactive position, the opening support is disposed along one of the front panel or the back panel, and in the active position, the opening support extends between the front panel and the back panel, across a corresponding longitudinal seam, to maintain the opening of the package in a wide-open position.

In some cases, the opening support may comprise a flexible strip of material defining a first end and a second end. In the inactive position, both the first end and the second end of the flexible strip of material may be removably attached to one of the front panel or the back panel, and, in the active position, the first end of the flexible strip of material may be removably attached to one of the front or back panels and the second end of the flexible strip of material may be removably attached to the other of the front or back panels, such that the flexible strip of material spans the corresponding longitudinal seam. A pressure sensitive adhesive may be applied to at least one of the first or second ends to form a respective region of pressure sensitive adhesive that is configured to removably attach the flexible strip of material to a respective one of the front or back panels.

Additionally or alternatively, a receiving feature may be applied to an outer surface of a respective one of the front or back panels to which the second end is configured to removably attach, where the receiving feature is configured to engage the second end. Applying the receiving feature may comprise forming a protrusion that extends outwardly from the outer surface of the respective one of the front or back panels, the method may further comprise forming an indentation in the second end of the flexible strip of material that is configured to engage the protrusion of the receiving feature in the active position. In some embodiments, the opening support may comprise a rigid member defining a fixed end and a free end. The rigid member may be configured to be moved between the inactive position, in which the rigid member is disposed along one of the front or back panels, and the active position, in which the rigid member extends across the longitudinal seam.

BRIEF DESCRIPTION OF THE SEVERAL VIEWS OF THE DRAWING(S)

Having thus described the disclosure in general terms, reference will now be made to the accompanying drawings, which are not necessarily drawn to scale, and wherein:

DETAILED DESCRIPTION OF THE DRAWINGS

The present invention now will be described more fully hereinafter with reference to the accompanying drawings in which some but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1A:
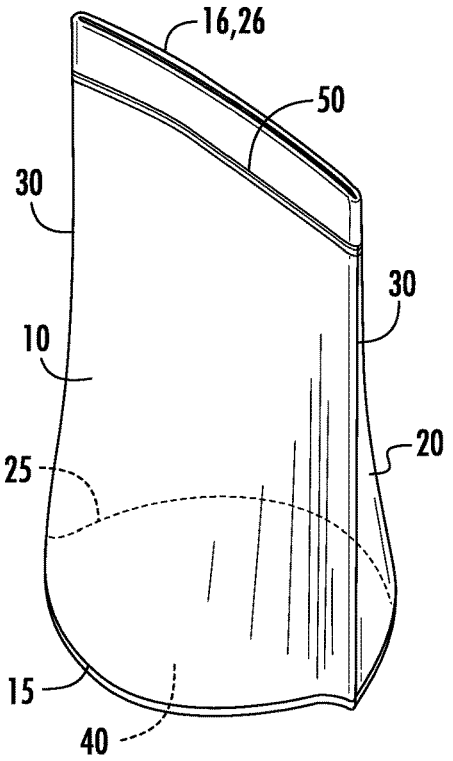
FIG. 1A is a perspective view of a package, the package being a stand-up pouch, where the package is in a closed configuration.
Figure 1B:
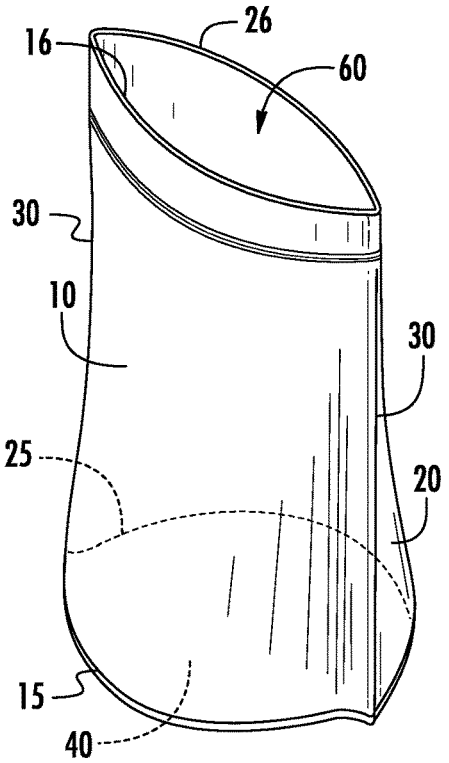
FIG. 1B is a perspective view of the package of FIG. 1A, where the package is in an open configuration.

Conventional packages made of flexible materials, such as various polymer-based materials, are often used to hold food products, such as baking ingredients (e.g., sugar, flax seed, oatmeal, etc.), snack foods (e.g., trail mix, nuts, fruit pieces, chips, etc.), and other bulk materials. Examples of such packages are illustrated in FIGS. 1A-2B. As depicted in the figures, such packages may, for example, have a front panel 10 and a back panel 20 that are joined to each other along respective side edges of the panels (e.g., via heat sealing) to create longitudinal seams 30. In some cases, the packages may be gusseted, as shown in FIGS. 1A and 1B, to form stand-up pouches. Thus, a base panel 40 may be connected to base ends 15, 25 of the respective front and back panels 10, 20 to form the base of the stand-up pouch. In other cases, the base ends 15, 25 may be joined to each other without the use of an additional base panel to form a bag, as shown in FIGS. 2A and 2B.

Figure 2A:
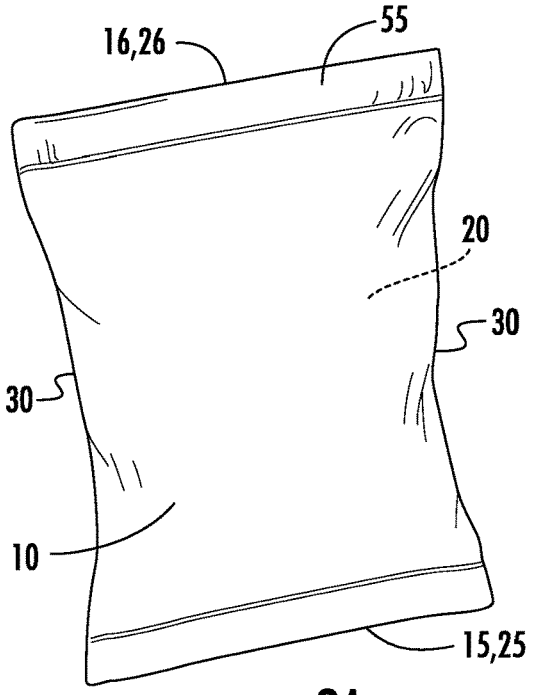
FIG. 2A is a perspective view of a package, the package being a bag, where the package is in a closed configuration.
Figure 2B:
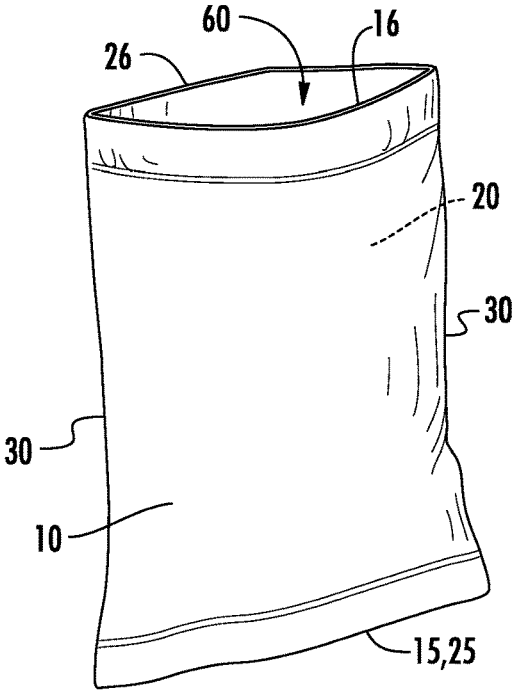
FIG. 2B is a perspective view of the package of FIG. 2A, where the package is in an open configuration.

Either way, a consumer may open the package by separating the front and back panels 10, 20, such as by opening a closure feature 50 (e.g., a zipper or tongue-and-groove mechanism) that joins the opening ends 16, 26 of the front and back panels together (see FIGS. 1A and 1B) or separating or cutting off a seal 55 provided at the opening ends 16, 26 (see FIGS. 2A and 2B).

Due to the thickness and/or resilient properties of the materials used to form the front and back panels 10, 20 of such packages, the opening 60 of the package (shown in FIGS. 1B and 2B) may have a tendency to revert back towards the closed position (shown in FIGS. 1A and 2A) as the front and back panels collapse towards each other. This results in the consumer having to manually separate the front and back panels 10, 20 each time he or she reaches in to withdraw additional product.

Accordingly, embodiments of the present invention provide a built-in opening support that can be actuated by the user to maintain the package in an open or wide-open configuration, thereby preventing or reducing the need to manually keep the front and back panels of the package separated as product is accessed. In this regard, the wide-open position of the opening of the package may be considered a configuration of the opening (e.g., size, shape, and/or spacing) that allows a consumer to easily reach into the package to withdraw product, without the need for further widening the opening. Embodiments of the invention are applicable in, and may be embodied by, various kinds of packages including stand-up pouches (e.g., FIGS. 1A and 1B), bags (e.g., FIGS. 2A and 2B), or any other package that includes front and back panels joined at longitudinal seams.

Figure 3A:
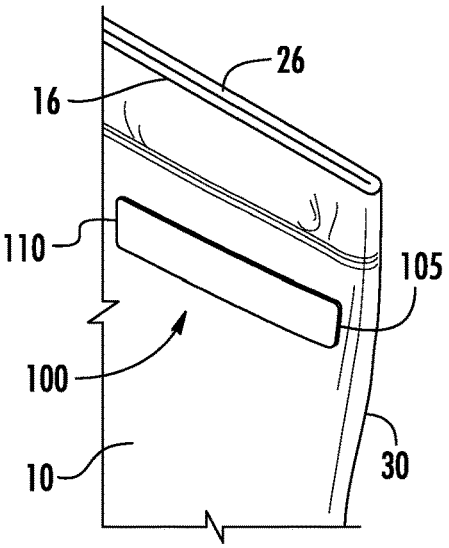
FIG. 3A illustrates a flexible strip of material forming an opening support in an inactive position according to an example embodiment.
Figure 3B:
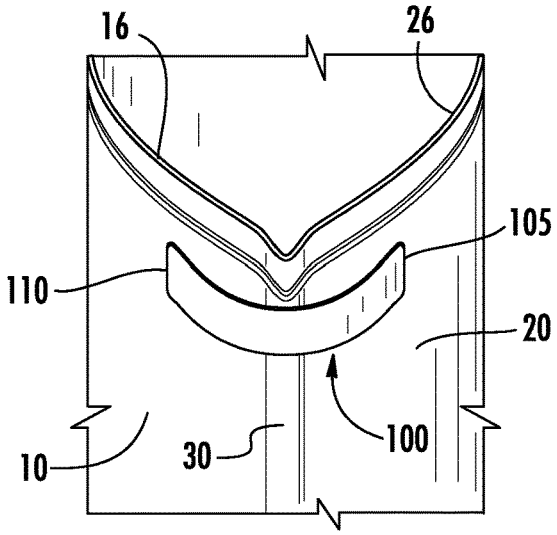
FIG. 3B illustrates the opening support of FIG. 3A in an active position according to an example embodiment.
Figure 4A:
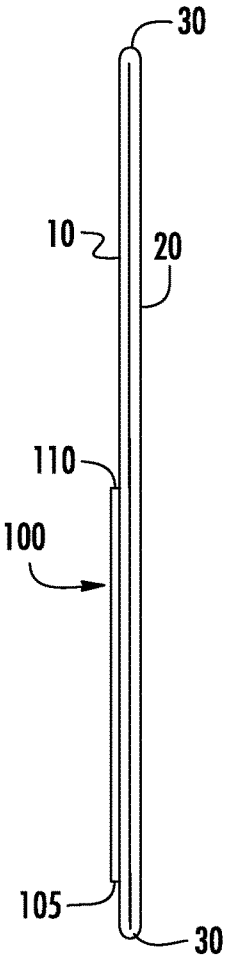
FIG. 4A is a top view of the package with the opening support of FIGS. 3A and 3B in the inactive position according to an example embodiment.
Figure 4B:
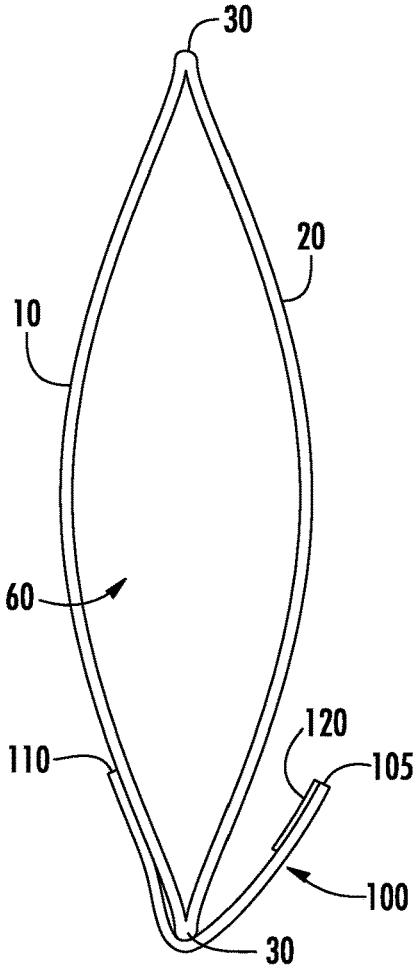
FIG. 4B is a top view of the package with the opening support of FIG. 4A in the process of being moved from the inactive position to the active position according to an example embodiment.
Figure 4C:
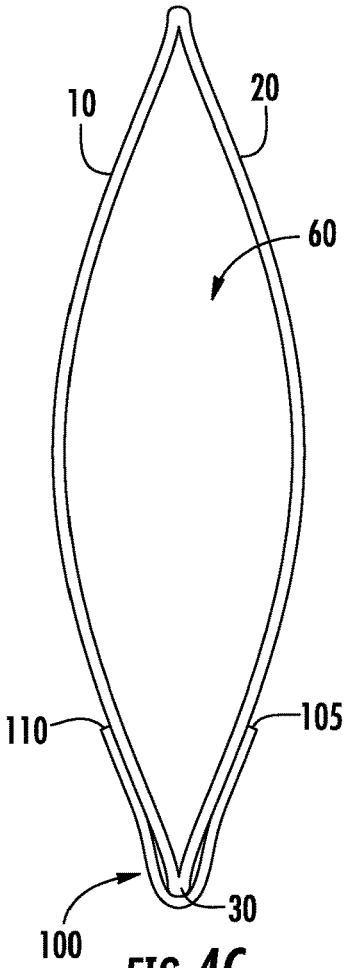
FIG. 4C is a top view of the package with the opening support of FIG. 4A in the active position according to an example embodiment.

With reference now to FIGS. 3A-4C, an opening support 100 is shown in accordance with one example embodiment. As shown, the opening support 100 may be disposed proximate the opening end 16, 26 of at least one of the front or back panels 10, 20 and may be configured to be moved from an inactive position (FIG. 3A) to an active position (FIG. 3B). In the inactive position, the opening support 100 may be disposed along one of the front panel or the back panel. In the depicted example of FIG. 3A, for example, the opening support 100 is disposed along the front panel 10. In the active position, the opening support may extend between the front panel 10 and the back panel 20, across the corresponding longitudinal seam 30, to maintain the opening of the package in an open position, as shown in FIG. 3B. A top view of the embodiment shown in FIGS. 3A and 3B is shown in FIGS. 4A-4C.

In some cases, such as in the embodiment of FIGS. 3A-4C, the opening support 100 may comprise a flexible strip of material defining a first end 105 and a second end 110. In the inactive position (FIGS. 3A and 4A), both the first end 105 and the second end 110 of the flexible strip of material are removably attached to one of the front panel 10 or the back panel 20. In the active position (FIGS. 3B and 4C), the first end 105 of the flexible strip of material is removably attached to one of the front or back panels 10, 20 and the second end 110 of the flexible strip of material is removably attached to the other of the front or back panels, such that the flexible strip of material spans the corresponding longitudinal seam 30.

Said differently, a consumer would purchase the package with the opening support 100 in the inactive position. In the example shown in FIGS. 3A-4C, the flexible strip of material forming the opening support 100 is initially positioned such that the entire strip is attached to only one of the panels 10, 20, such as the front panel 10 as shown. When the consumer opens the package to access product held therein, he or she would manually separate the front and back panels 10, 20 to open the package at the respective opening ends 16, 26. Rather than holding the package open with his or her hand while withdrawing product, the consumer would move the flexible strip of material forming the opening support 100 in this embodiment from the inactive position (FIGS. 3A and 4A) to the active position (FIGS. 3B and 4C), such that the flexible strip extends over and spans the corresponding longitudinal seam 30. In other words, instead of both ends 105, 110 of the flexible strip being attached to a single panel 10, 20, now one end 105 is attached to the back panel 20 and the other end 110 is attached to the front panel 10. In this way, the flexible strip serves to apply tension across the longitudinal seam 30 to pull the attached portions of the respective panels 10, 20 away from each other, thereby maintaining an open position of the package opening 60.

The flexible strip of material may be, for example, a strip of polymer material, such as polyethylene (PE) or polyethylene terephthalate (PET), polypropylene (PP), oriented polypropylene (OPP), nylon, biaxially oriented nylon (BON), etc. In some cases, each of the first and second ends 105, 110 of the opening support 100 may include a region of pressure sensitive adhesive 120 (shown on the first end 105 in FIG. 4B) that is configured to removably attach the flexible strip of material to a respective one of the front or back panels. In that way, the user may be able to peel opening support 100 from the first panel 10 (in the embodiment of FIGS. 3A and 4A, for example) and reposition the opening support across the respective longitudinal seam 30 to maintain the package in the open configuration, as shown in FIGS. 3B and 4C.

In this regard, the opening support 100 may, in some cases, be cut out of the material forming one of the layers of the package itself. In the case of a package formed from a laminate structure having an outer film layer and one or more inner film layers, for example, the opening support 100 may be part of the outer film layer and may be defined via laser scoring or die cutting the shape of the opening support out of the outer layer. The pressure sensitive adhesive 120 may thus be pattern applied between the outer film layer and an adjacent layer of the laminate structure in the area of the opening support 100. The PSA may remain with the opening support 100, thereby allowing the user to re-apply the opening support across the longitudinal seam 30 as described above after it has been peeled away from the outer film layer. In other embodiments, however, the opening support 100 may be an additional strip of material that is removably attached to the outer surface of the package (e.g., via adhesive), such as to the outer surface of an outer film layer of the package.

With reference now to FIGS. 5A-6C, in some embodiments, the opening support 100 may be configured such that one of the ends remains fixed to one of the panels of the package, while the other end is configured to be moved to the other panel to support the opening. For example, as shown in FIG. 6A, the opening support 100 may comprise a flexible strip of material 130 defining a first end 135 and a second end 140. In the inactive position, the first end 135 may be fixedly attached to one of the front panel 10 or the back panel 20 (e.g., the front panel in FIGS. 5A-6C). The second end 140 may, however, be removably attached to the same one of the front panel 10 or the back panel 20 (e.g., the front panel in FIGS. 5A-6C). Thus, in the active position, the second end may be configured to attach to the other of the front panel or the back panel (e.g., the back panel 20 in FIGS. 5A-6C), such that the flexible strip of material 130 folds over onto itself to span the corresponding longitudinal seam 30.

Figure 6A:
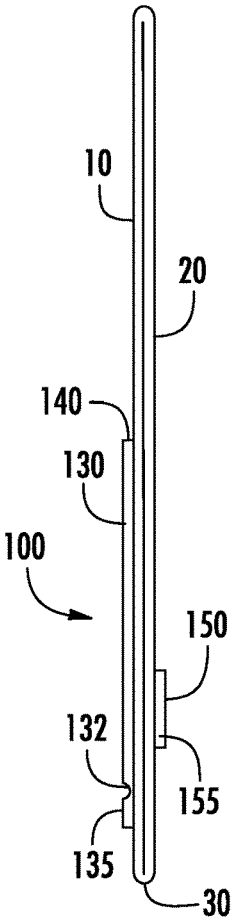
FIG. 6A is a top view of the package with the opening support of FIGS. 5A and 5B in the inactive position according to an example embodiment.
Figure 6B:
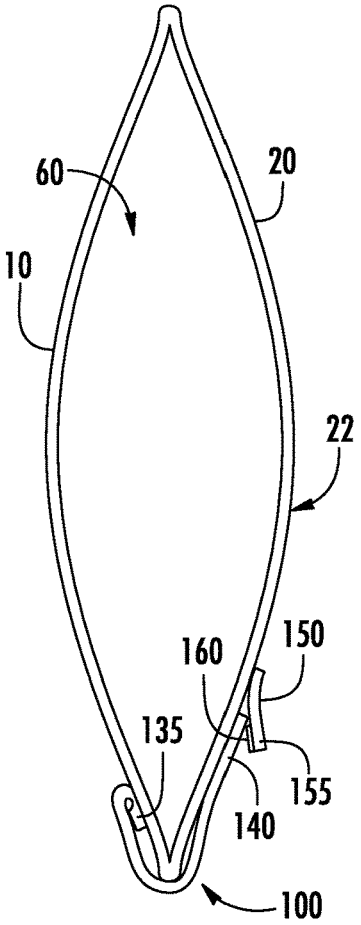
FIG. 6B is a top view of the package with the opening support of FIG. 6A in the process of being moved from the inactive position to the active position according to an example embodiment.
Figure 6C:
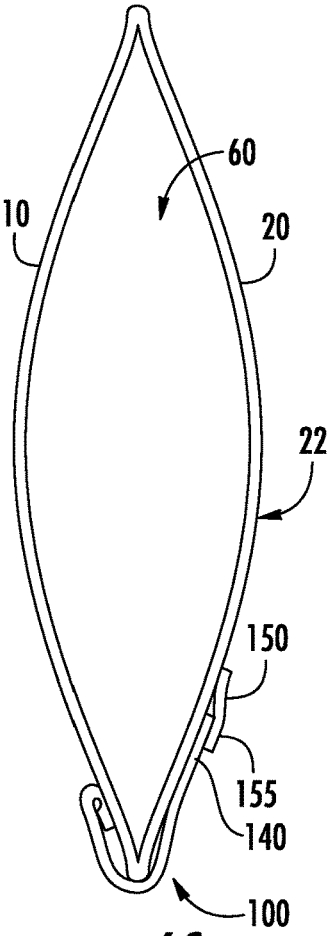
FIG. 6C is a top view of the package with the opening support of FIG. 6A in the active position according to an example embodiment.

In this regard, the flexible strip of material 130 may include a notch 132 or other hinge feature, such as a living hinge, that allows the flexible strip to bend at the location of the feature and, thus, facilitates a user's movement of the second end 140 from its original, inactive position (FIG. 6A) to its subsequent active position (FIG. 6C).

Figure 5A:
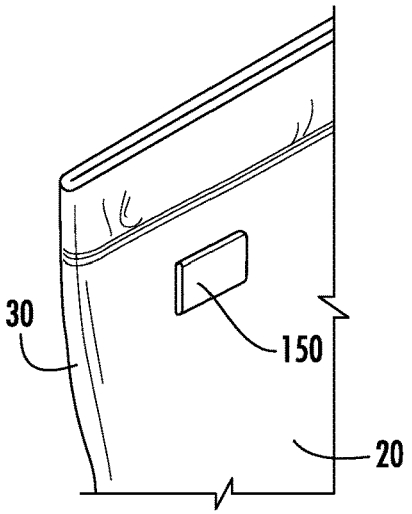
FIG. 5A illustrates a receiving feature of an opening support in an inactive position according to another example embodiment.
Figure 5B:
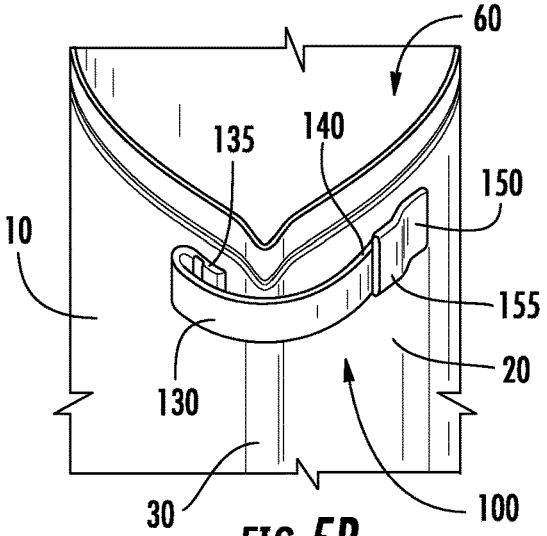
FIG. 5B illustrates the opening support of FIG. 5A in an active position according to an example embodiment.

In some cases (not shown), the second end 140 of the flexible strip of material 130 may include a region of pressure sensitive adhesive, such as on an outward-facing surface of the second end when the opening support is in the inactive position of FIG. 6A, and the region of pressure sensitive adhesive may be configured to removably attach the flexible strip of material to a respective one of the front or back panels 10, 20 in the active position. Although the region of pressure sensitive adhesive may initially be outwardly-facing (e.g., in the position shown in FIG. 6A), when the flexible strip of material 130 is folded over itself as shown in FIGS. 5B, 6B, and 6C, the region of pressure sensitive adhesive may face the outer surface of the respective panel (the back panel 20 in the corresponding Figs.), such that the second end 140 can be removably attached to that panel and maintain the opening 60 of the package in a wide open position. In such embodiments, the region of PSA may initially be covered in the inactive position, such as by a liner, to prevent the PSA from being touched or inadvertently adhered to unintended surfaces.

Figure 9A:
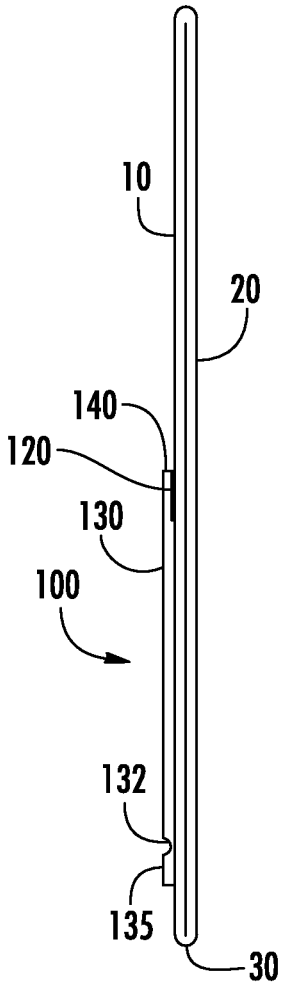
FIG. 9A is a top view of the package with the opening support that includes a flexible strip of material with an inward-facing region of pressure sensitive adhesive in the inactive position according to an example embodiment.
Figure 9B:
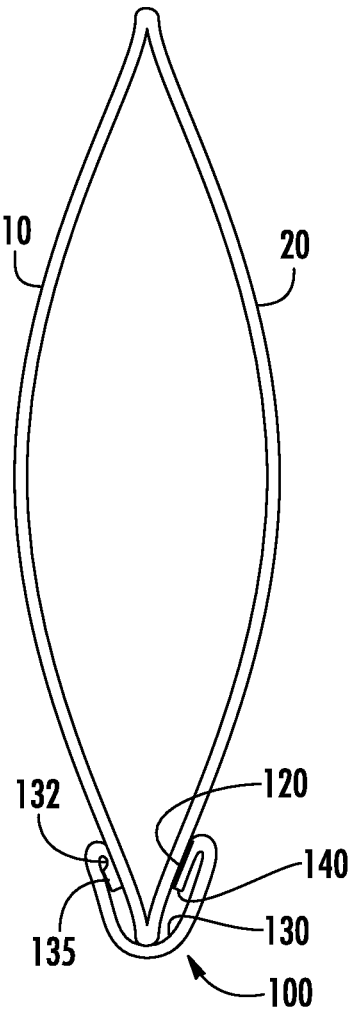
FIG. 9B is a top view of the package with the opening support of FIG. 9A in the active position according to an example embodiment.

In still other embodiments, however, the region of pressure sensitive adhesive may be provided on an inward-facing surface of the second end when the opening support is in the inactive position, such that it is not exposed and need not be protected by a liner. When moved towards the active position, the flexible strip of material 130 may be folded over itself twice (e.g., once proximate the first end 135 and once proximate the second end 140), such that the pressure sensitive adhesive ends up facing the outer surface of the respective panel (e.g., the back panel 20). This is illustrated in FIGS. 9A (inactive position) and 9B (active position).

In other cases, such as in the example depicted in FIGS. 5A-6C, an outer surface of a respective one of the front or back panels 10, 20 to which the second end is configured to removably attach may comprise a receiving feature 150 that is configured to engage the second end 140. As illustrated in FIG. 6B, the receiving feature 150 may comprise a removable flap 155 comprising a region of pressure sensitive adhesive 160 that is configured to removably attach to the second end 140 of the flexible strip of material 130 in the active position, as shown in FIGS. 5B, 6B, and 6C. Accordingly, as shown in the depicted example, the second end 140 may, in the active position, be received between the outer surface 22 of the back panel 20 and an inner surface of the removable flap 155 (e.g., the region of pressure sensitive adhesive 160), thus being secured therebetween in the active position. Thus, in these embodiments, the region of PSA 160 may be located on the receiving feature 150 instead of or in addition to being located on the flexible strip of material 130.

In some cases, such as in applications where the package is not designed to be reusable, adhesives other than pressure sensitive adhesive may be used in the embodiments described above with respect to FIGS. 3A-6C. Such non-pressure sensitive adhesives may be configured to provide greater adhesive force between the opening feature and the package to more permanently maintain the package in the open configuration. Moreover, although the embodiments described above with respect to FIGS. 5A-6C include a region of pressure sensitive adhesive that is provided on an inner surface of the flap 155 (e.g., adjacent the outer surface of the package, but located on the receiving member 150), in other embodiments the receiving member 150 may be configured such that the flap 155, when peeled away from the package, exposes an adhesive layer of the laminate forming the package itself. The flexible strip of material may thus, in some cases, be configured to adhere to the package, rather than to the receiving member 150, and in some cases the receiving member may be designed to be completely separated from the package and thrown away once the adhesive layer is revealed. In such cases, the receiving member 150 may comprise a portion of an outer layer of the laminate structure forming the package, for example, the receiving member being defined by a cut line made in the outer layer of the package, as described above.

Figure 7A:
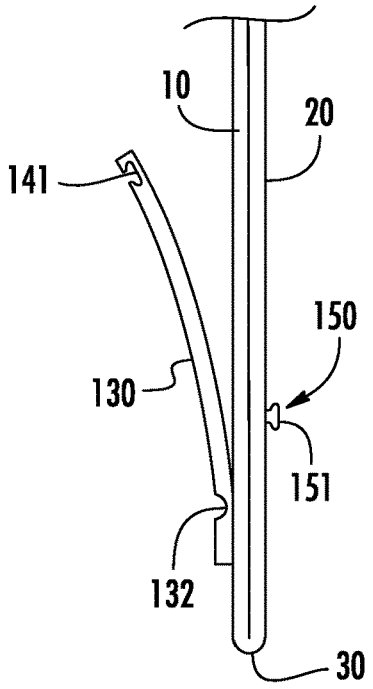
FIG. 7A is a top view of a package with an opening support that includes a flexible strip of material and a receiving member in the form of a protrusion in an inactive position according to another example embodiment.
Figure 7B:
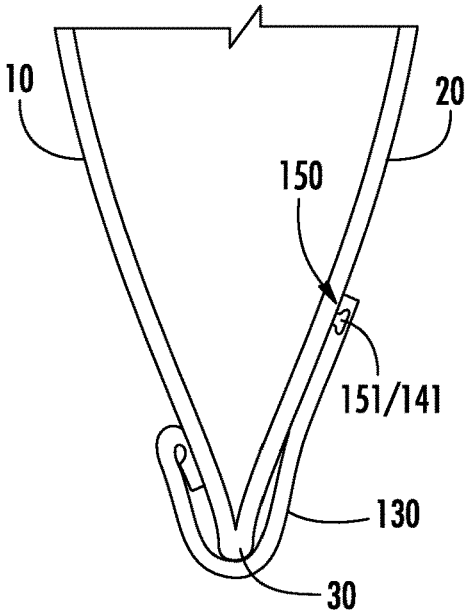
FIG. 7B is a top view of a package with the opening support of FIG. 7A in an active position according to an example embodiment.

Turning to FIGS. 7A and 7B, in some embodiments, the receiving feature 150 may comprise a protrusion 151 that is configured to be engaged with and mechanically attached to the second end 140 of the flexible strip of material 130. The protrusion 151 may, for example, be an outward extension from the surface of the respective panel (e.g., the back panel 20 in the depicted embodiment), and the portion of the extension closest to the attached panel may in some cases be narrower than the end of the extension farthest from the attached panel, as shown. The second end 140 of the flexible strip of material 130 may, in turn, comprise an indentation 141 that is configured (e.g., sized and shaped) to engage the protrusion 151 of the receiving feature 150 in the active position (e.g., when the second end has been moved towards the receiving feature and, in some cases, applied to the receiving feature with some degree of force to effect the engagement). In some embodiments, the indentation 141 may be cut all the way through the flexible strip of material 130, such that the indentation is a hole formed through the flexible strip that is configured to form a friction fit with the protrusion 151 to effect engagement.

Although the receiving feature 150 is shown and described above as a flap 155 with pressure sensitive adhesive 160 in some embodiments and as a protrusion 151 in other embodiments, various types of receiving features may be used, including hooks, loops, slits, etc. provided on one or both of the flexible strip of material 130 and/or the receiving feature 150 itself.

Figure 8A:
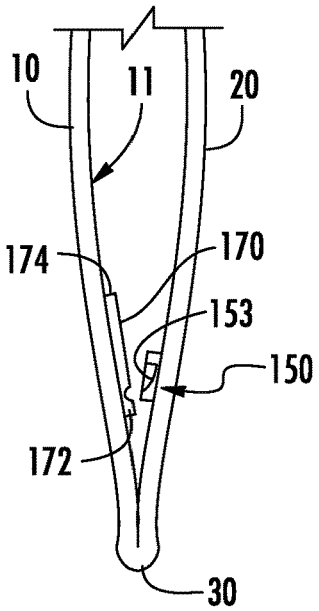
FIG. 8A is a top view of a package with an opening support that includes a rigid member and a receiving member in an inactive position according to another example embodiment.
Figure 8B:
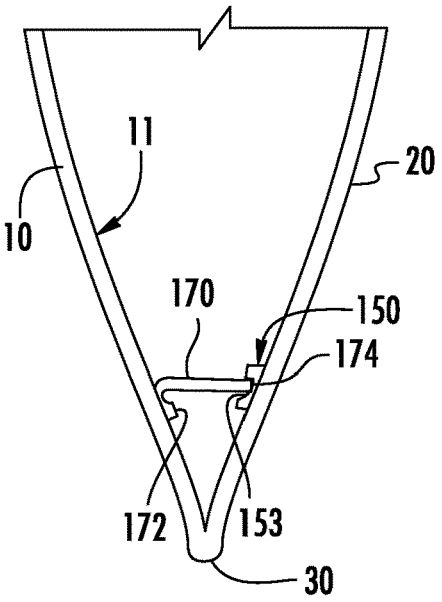
FIG. 8B is a top view of a package with the opening support of FIG. 8A in an active position according to an example embodiment.

As described above and depicted in FIGS. 3A-7B and 9A-9B, in some cases the opening support 100 is disposed on an outer surface of the package. In other embodiments, however, the opening support 100 may be disposed on an inner surface of the package, as shown in FIGS. 8A and 8B. With reference to FIGS. 8A and 8B, for example, the opening support may comprise a rigid member 170 disposed on an inner surface of the respective panel (e.g., the inner surface 11 of the front panel 10 in the depicted embodiment). The rigid member 170 may define a fixed end 172 and a free end 174. The rigid member 170 may be configured to be moved between the inactive position (shown in FIG. 8A), in which the rigid member is disposed along one of the front or back panels, and the active position (shown in FIG. 8B), in which the rigid member extends across the longitudinal seam 30. In essence, the rigid member 170 may be configured to push apart the front and back panels 10, 20 and maintain a distance between the two panels, thereby maintaining the opening 60 of the package in an open position.

In some cases, the free end 174 of the rigid member 170 may be configured to engage a receiving member 150 disposed on the other of the front or back panels (e.g., the back panel 20 in the depicted embodiment) when the opening support is in the active position, as shown in FIG. 8B. For example, the receiving member 150 may comprise a groove 153 configured to receive the free end 174 of the rigid member 170 to lock the rigid member in the active position. Once inserted into the groove 153, for example, the free end 174 may remain in the groove until withdrawn by the user, thereby allowing the package to stay in the active position (e.g., the open configuration) for as long as desired.

Although in the embodiments of FIGS. 8A and 8B the rigid member 170 is shown as being disposed on an inner surface of the respective panel, in other embodiments the rigid member may be disposed on an outer surface of the respective panel and may be configured similarly (with respect to movement, position, and function) to the embodiments shown and described in connection with FIGS. 5A-7B.

Embodiments of a method of manufacturing a package including an opening support as described above are also provided herein. The method may, for example, comprise forming a front panel defining an opening end, a base end, and two side edges and attaching a back panel defining an opening end, a base end, and two side edges to the front panel via longitudinal seams formed along respective side edges of the front and back panels. An opening support may be disposed proximate the opening end of at least one of the front or back panels, where the opening support is configured to be moved from an inactive position to an active position. The opening end of the front panel and the opening end of the back panel may define an opening of the package configured to provide access to contents of the package when the package is opened by a user. As described above, in the inactive position, the opening support may be disposed along one of the front panel or the back panel, whereas in the active position, the opening support may extend between the front panel and the back panel, across a corresponding longitudinal seam, to maintain the opening of the package in a wide-open position.

As described above, the opening support may comprise a flexible strip of material defining a first end and a second end, wherein, in the inactive position, both the first end and the second end of the flexible strip of material are removably attached to one of the front panel or the back panel. In the active position, the first end of the flexible strip of material may be removably attached to one of the front or back panels and the second end of the flexible strip of material may be adhered to the other of the front or back panels, such that the flexible strip of material spans the corresponding longitudinal seam.

In some embodiments, the method may include applying pressure sensitive adhesive to at least one of the first or second ends to form a respective region of pressure sensitive adhesive configured to removably attach the flexible strip of material (or a portion thereof) to a respective one of the front or back panels. In still other embodiments, a receiving feature as described above may be applied to an outer surface of a respective one of the front or back panels to which the second end is configured to removably attach. The receiving feature may be configured to engage the second end, such that the package is maintained in the open configuration.

For example, applying the receiving feature may comprise forming a protrusion that extends outwardly from the outer surface of the respective one of the front or back panels, and the method may further include forming an indentation in the second end of the flexible strip of material that is configured to engage the protrusion of the receiving feature in the active position.

In still other cases, as described above, the opening support may comprise a rigid member defining a fixed end and a free end. The rigid member may be configured to be moved between the inactive position, in which the rigid member is disposed along one of the front or back panels, and the active position, in which the rigid member extends across the longitudinal seam.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A method of manufacturing a package including an opening support, the method comprising:

forming a front panel defining an opening end, a base end, and two side edges;

attaching a back panel defining an opening end, a base end, and two side edges to the front panel via longitudinal seams formed along respective side edges of the front and back panels; and disposing an opening support proximate the opening end of at least one of the front or back panels, the opening support configured to be moved from an inactive position to an active position, wherein the opening end of the front panel and the opening end of the back panel define an opening of the package configured to provide access to contents of the package when the package is opened by a user, wherein, in the inactive position, the opening support is disposed along one of the front panel or the back panel, wherein, in the active position, the opening support extends between the front panel and the back panel, across a corresponding longitudinal seam, to maintain the opening of the package in a wide-open position, wherein the opening support comprises a flexible strip of material defining a first end and a second end, wherein, in the inactive position, the first end is fixedly attached to one of the front panel or the back panel and the second end is removably attached to the same one of the front panel or the back panel, and wherein, in the active position, the second end is configured to attach to the other of the front panel or the back panel, such that the flexible strip of material spans the corresponding longitudinal seam, and wherein an outer surface of a respective one of the front or back panels to which the second end is configured to removably attach includes a receiving feature configured to engage the second end.

2. The method of claim 1, wherein the second end of the flexible strip includes pressure sensitive adhesive configured to removably attach the second end of the flexible strip of material to a respective one of the front or back panels.

3. The method of claim 1, wherein the receiving feature includes a protrusion that extends outwardly from the outer surface of the respective one of the front or back panels, and the flexible strip further includes an indentation in the second end of the flexible strip configured to engage the protrusion of the receiving feature in the active position.

4. The method of claim 1, further comprising a base panel connecting the base end of the front panel to the base end of the back panel, such that the package is a stand-up pouch.

5. The method of claim 1, wherein the receiving feature comprises a removable flap that includes a region of pressure sensitive adhesive configured to removably attach to the second end of the flexible strip of material in the active position.

6. The method of claim 1, wherein the receiving feature comprises a protrusion, and wherein the second end of the flexible strip of material includes an indentation configured to engage the protrusion of the receiving feature in the active position.

7. A method of manufacturing a package including an opening support, the method comprising:

forming a front panel defining an opening end, a base end, and two side edges;

attaching a back panel defining an opening end, a base end, and two side edges to the front panel via longitudinal seams formed along respective side edges of the front and back panels; and disposing an opening support proximate the opening end of at least one of the front or back panels, the opening support configured to be moved from an inactive position to an active position, wherein the opening end of the front panel and the opening end of the back panel define an opening of the package configured to provide access to contents of the package when the package is opened by a user, wherein, in the inactive position, the opening support is disposed along one of the front panel or the back panel, wherein, in the active position, the opening support extends between the front panel and the back panel, across a corresponding longitudinal seam, to maintain the opening of the package in a wide-open position wherein the opening support is disposed on an inner surface of the package, and wherein the opening support comprises a rigid member defining a fixed end and a free end.

8. The method of claim 7, wherein the free end is configured to engage a receiving member disposed on the other of the front or back panels when the opening support is in the active position.

9. The method of claim 8, wherein the receiving member comprises a groove configured to receive the free end of the rigid member to lock the rigid member in the active position.

* * * * *